US005101934A

United States Patent [19]

Zumbro

[11] Patent Number: 5,101,934

[45] Date of Patent: Apr. 7, 1992

[54] TREE STAND

[75] Inventor: Daniel R. Zumbro, Stockport, Ohio

[73] Assignee: Double 0-7, Inc., Fond du Lac, Wis.

[21] Appl. No.: 635,216

[22] Filed: Dec. 28, 1990

[51] Int. Cl.[5] ..... A63B 27/00; A01M 31/02

[52] U.S. Cl. ..... 182/187; 182/135

[58] Field of Search ..... 182/187, 188, 134–136; 24/129 R, 129 A, 115 H

[56] References Cited

U.S. PATENT DOCUMENTS

| | | | |
|---|---|---|---|
| 122,135 | 12/1871 | Taylor | 24/129 R |
| 2,932,072 | 4/1960 | Prunhnow | 24/129 R |
| 4,105,349 | 8/1978 | Kupperman | 24/129 R |
| 4,428,459 | 1/1984 | Peck | 182/187 |
| 4,597,473 | 7/1986 | Peck | 182/187 |
| 4,722,421 | 2/1988 | Hilbert | 182/187 |
| 4,802,552 | 2/1989 | Williams | 182/187 |
| 4,831,692 | 5/1989 | Chuan | 24/129 R |
| 4,890,694 | 1/1990 | Williams | 182/187 |
| 4,936,415 | 6/1990 | Williams | 182/187 |
| 4,953,662 | 9/1990 | Porter | 182/187 |
| 4,989,766 | 2/1991 | Lewallyn | 182/187 |

OTHER PUBLICATIONS

1990 Brochure "Total Shooting Systems, Inc. Manufactuers of Tomorrow's Hunting Equipment Today!".

*Primary Examiner*—Reinaldo P. Machado
*Attorney, Agent, or Firm*—Foley & Lardner

[57] ABSTRACT

A combination two-piece tree stand includes a climbing platform and a locking element. The two components interlock to fasten the components to one another and to add substantial stability to the individual components. The stand includes a generally horizontal platform havig a notch portion for engaging the tree and a band for surrounding the tree in a known configuration. The locking component includes, in the preferred embodiment, a pair of legs insertable into a portion of the platform which converge to engage the tree at a location above that of the platform. A cross member between the legs is fastened, e.g. by a strap, rope or web, to a component of the platform to draw the locking device downwardly toward the platform and urge the converging portion of the legs into tighter engagement with the tree. Substantially increased stability results from the arrangement disclosed herein.

17 Claims, 2 Drawing Sheets

TREE STAND

BACKGROUND OF THE INVENTION

1. Field of the Invention

The present invention relates generally to the art of tree stands, and more particularly to the type of tree stands which are used for photographing or hunting and which may be used in combination with a seat. The tree stand may be of the climbing variety, as will be illustrated later herein. Still more specifically, the invention relates to a combination two-piece locking stand having a component which interlocks with a platform component to provide the advantages of a platform stand, with greater stability than that encountered in prior art devices.

2. Description of the Prior Art

Tree stands have been used for many years by hunters, photographers and naturalists to obtain an elevational viewing position. Many of these stands include a platform supported against an upright member, such as a tree or utility pole. The platform typically includes a notch located at one end of the platform adapted to be placed against the upright member. Also provided in prior art devices is a flexible band or belt encircling the upright member to support the platform. Most prior art tree stands also include means for adjusting the length of the band to accommodate the periphery of the particular upright member and maintain the platform in a substantially horizontal position.

Platforms of this type have been disclosed in U.S. Pat. No. 4,428,459 and No. 4,597,473, each respectively issued to Paul L. Peck. Other patents describing tree stands include U.S. Pat. No. 4,427,092 issued to Lynn A. Tentler and U.S. Pat. No. 4,722,421 issued to Thomas F. Hilbert.

Tree stands of the climbing variety are also known. In these stands, straps are provided for attaching the platform to the boot or shoe of the user and a webbing device is tied around the upright member above the platform. When the user pulls downwardly on the strap and lifts the platform upwardly against the resistance of the strap, the entire platform can be raised to a higher location on the upright member. During such movement, the platform assumes a generally angular orientation. When the notch has been raised, and the platform lowered to a horizontal position, a new height has been achieved. Movement of the strap to a still higher location, and repeating the procedure, can continue until the stand is in its ultimate desired location.

It is also known that seating devices can be used in tree stands and typically these include a canvas strap and frame member for supporting the user. A safety harness is desirably used with all such stands. To the knowledge of the present inventor, there have not been any attempts to combine seating devices with tree stands in a manner which would lead to greater stability of the tree stand. Certain prior art seats, which are independently attached to the upright member, are shown in the enclosed brochure of Total Shooting Systems, Inc. dated 1990, a copy of which is included with the specification. Use of the combination two-piece stand which is the subject matter of the present invention is also illustrated in the aforementioned brochure, as is the process of climbing using tree stands of the type to which this present invention pertains. Numerous prior art tree stands are also shown.

One frequently encountered problem with tree stands is the lack of stability if the weight of the user is shifted from side to side. Serious injury can result from the lack of stability, especially during affixing the stand to the tree or in case the user is not wearing the recommended safety harness. It would be highly desirable to create a stand which has increased stability and which overcomes this problem with the prior art. A stand which would accomplish this objective in a simple manner and without unnecessarily complicating the installation process would be especially desirable.

SUMMARY OF THE INVENTION

The present invention provides a combination two-piece tree stand which features enhanced stability and ease of installation. Another feature of the present invention is employing a platform as one component and a seat as the second. The invention is also applicable to stands and supporting devices, other than those which involve the use of a seat. A feature of the invention is that it may be readily adapted to stands of the climbing variety and, with relatively minor modifications, may be added to existing stands to provide greater stability.

A further feature of the present invention is a locking technique for drawing parts of the stand and platform toward one another to produce increased stability, and a still further feature of the invention relates to a particular locking arrangement for a rope or strap which may be used for the tree stand device of the invention or for other applications where it is desired to securely fasten an elongate member to a part.

How these and other features of the invention are accomplished will be described in the following specification, taken in conjunction with the drawings. Generally, however, they are provided by a combination stand which includes a first platform component. The platform component includes a notch for engaging the periphery of an upright member, such as a tree. Attached to the end of the platform opposite from that abutting the tree is an adjustable band member which surrounds the tree to provide a supporting function. Means such as those known in the prior art may be employed for adjusting the length of the band to take into account the different diameters of upright members with which the platform can be used. A second component of the preferred embodiment of the invention, which may be a seat component, is elongate and in the preferred embodiment is constructed from a pair of side members. The side members converge to a notch which again is adapted to abut the upright member, while the outer ends of the side members are adapted to be attached in the platform. They may be received in a fixed relationship or may be pivotably joined thereto. A cross member is provided intermediate the side members and a strap, such as a rope or webbing, is employed to surround the cross member and a portion of the platform to draw those two structural members toward one another. The pressure exerted during the fastening of the strap results in a locking of the notch of the second component and downward pressure on the outer end of the platform thereby securing more tightly the fastening band around the upright member. Greater stability, especially in the case of side-to-side weight shifts, results. In the most preferred embodiment, the above-referenced features also are accomplished by providing a seat on the second component which may include a rounded tubular member and canvas seating straps. Other ways in which the features of the invention are accomplished will become readily apparent to those skilled in the art after reading the description of the preferred embodiment which follows. Those other features are deemed to fall within the scope of the invention if they fall within the scope of the claims which follow.

DESCRIPTION OF THE DRAWINGS

In the various FIGURES, like reference numerals are used to illustrate like components.

DETAILED DESCRIPTION OF THE PREFERRED EMBODIMENT

Before proceeding to the detailed description of the FIGURES, several general comments can be made about the applicability of the present invention to other types of tree stands and seats. A brochure has been provided with the specification showing a number of different types of stands, some of which include a plurality of rungs, which type will be used to describe the preferred embodiment. The brochure also illustrates generally flat metal or wood platforms of one piece construction which may also be used.

In addition to the configuration of the platform, many different devices are known for attaching the platform to the tree, such as those illustrated in the aforementioned patents and those illustrated in the brochure. In and of themselves, the shape of the platform and the particular configuration of the retaining straps are not critical to the invention. Furthermore, the present invention will be described in conjunction with climbing tree stands, i.e., those which include a mechanism, usually rubber loops, for attachment to the boot or shoe of the user. Such components need not be employed with the present invention, or the present invention can be adapted to other types of climbing assemblies.

The present specification will also not describe in any significant detail the method of using the climbing feature, inasmuch as that feature, in and of itself, is well-known and is illustrated in the brochure submitted herewith.

Figure 1:
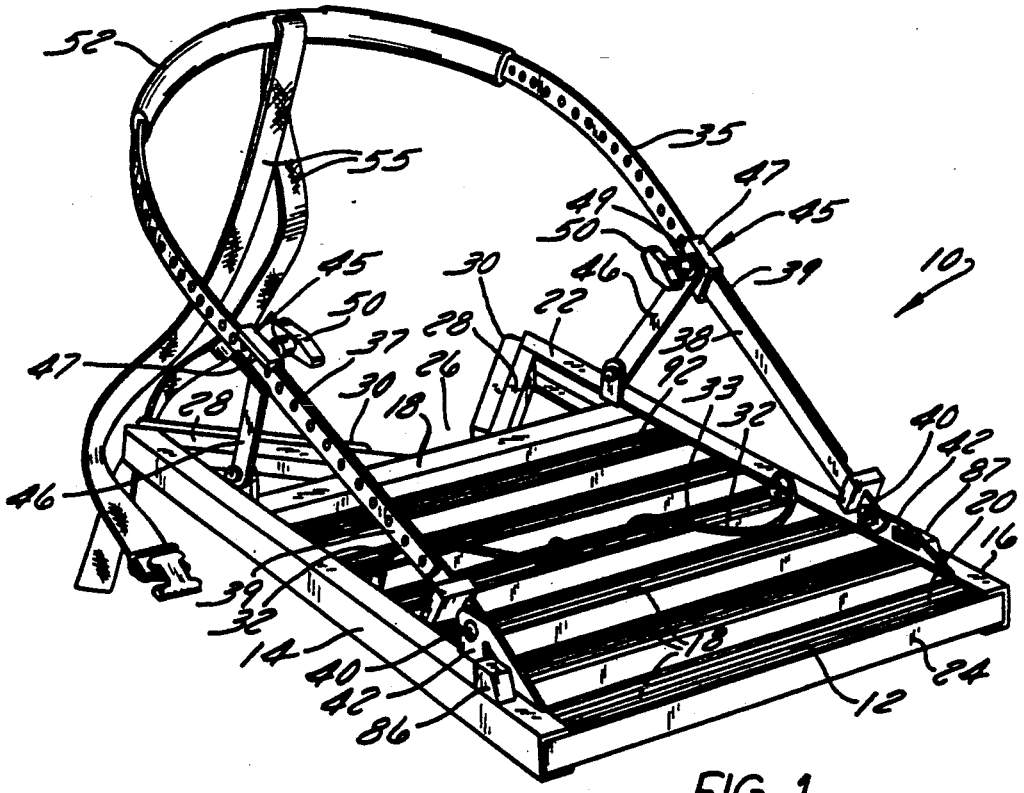
FIG. 1 is a perspective view of a tree stand according to a preferred form of the present invention.

Proceeding now to a description of FIG. 1, a tree stand of the prior art is shown as numeral 10. Tree stand 10 includes a platform 12 including a pair of parallel and spaced apart side members 14 and 16 having a plurality of rungs 18 secured therebetween. In the illustrated embodiment, side members 14 and 16 are generally elongate, aluminum, channels, rectangular in cross-section, and rungs 18 are welded thereto. The upper surface 20 of rungs 18 include ridges to provide traction for the upper portion of platform 12. Platform 12 includes an inner end 22 and an outer end 24. End 22 is formed in the shape of a notch 26 by a pair of angled members 28 which extend from the inner end of side members 14 and 16 toward the middle of the rung 18 nearest end 22. To provide protection for the tree with which the device is to be used, rubber padding, as shown at 30, is provided on members 28. As previously mentioned, the shape of the notch can be widely varied and, in and of itself, is not part of the present invention.

Platform 12 also includes rubber climbing loops 32 shown generally in FIG. 1, loops 32 being secured on either end and at the middle of rung 33 by any suitable securing technique. One end of the rubber loop is attached generally adjacent side member 14 while the other end thereof is attached generally adjacent side member 16. The intermediate portion of the rubber loop 32 can be attached at the middle of the rung 33 if desired.

Stand 10 also includes a generally elongate band 35 for being secured around the tree above the level of notch 26. In the illustrated embodiment, the band comprises three sections which will be described in sequence. The first two sections 37 and 38 are pivotally attached to the side members 14 and 16 generally adjacent the outer end 24 of platform 12 by the bolt 40 passing through a flange 42 extending generally upwardly from those areas. Sections 37 and 38 are made of flexible steel and have apertures therethrough, the purpose of which will be described shortly. The intermediate section 39 of band 35 also includes apertures along its length and is adapted to be coupled to portions 37 and 38 using a threaded coupling systems illustrated generally at 45. Coupling systems 45 are each supported from a generally shorter metal plates 46 which are pivotally coupled to side members 14 and 16 near the notch 26. The upper ends of plates 46 include a clamp for surrounding the overlapping portions of parts 37 and 39, and 38 and 39, respectively with a collar 47 being provided for receiving a threaded member 49 adapted to penetrate the two portions, pass through the respective apertures therein and clamp downwardly on the band members to retain them in place. A handle 50 is provided for each clamping element 45 to permit loosening and tightening as desired. In the illustration, rubber members 52 are also provided at the intermediate section 39 to prevent damage to the tree with which the stand is used.

It will be appreciated by those familiar with the art of tree stand manufacture and use that the length of the band 35 is adjustable to accommodate different sized trees and the pivoting connections, which are the subject of prior art patents previously discussed, could be replaced by other devices which are also well-known in the art. A safety strap 55 is also attached to band portion 39 for being secured about the tree as is well known. As previously indicated, the description of FIG. 1 has been for purposes of illustration rather than limitation.

Figure 2:
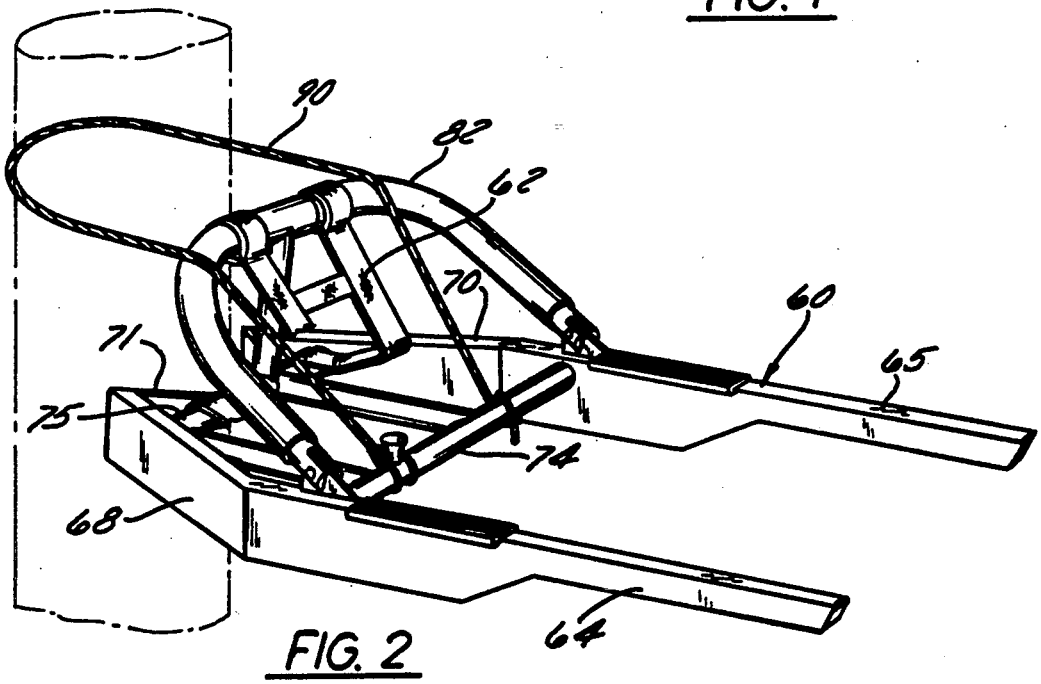
FIG. 2 is a perspective view of the preferred second locking device according to the present invention.

FIG. 2 illustrates the second component of the present invention, namely a locking member 60 which, in the illustrated embodiment, includes a seat 62. Locking member 60 is comprised of a pair of spaced apart and parallel side members 64 and 65, which again in the preferred embodiment are made from tubular aluminum, and which are generally rectangular in cross-section. Members 64 and 65 have an inner and an outer end (with reference to the tree with which the device will be used). Welded to the inner ends of sides 64 and 65 are converging elements 68 and 70 which form a notch 71 for the locking element, again adapted to contact a tree. Rubber protectors for the tree surface (not shown) may be provided if desired. Locking member 60 also includes a pair of parallel but spaced apart rods 74 and 75, rod 74 extending between elements 64 and 65 generally adjacent their innermost ends, while rod 75 extends between the inner surfaces of the converging extensions 68 and 70.

A seat 62, the form of which is not critical to the invention, includes a generally curved tubular piece of aluminum 82 secured to members 64 and 65 and web straps 83 of seat 62 which extend between tube 82 and rod 75. Any other conventional seat arrangement can be used and the invention is not to be limited by this particular description of a seat arrangement. The seat may be collapsible or fixed in place, as is known to the art.

Figure 3:
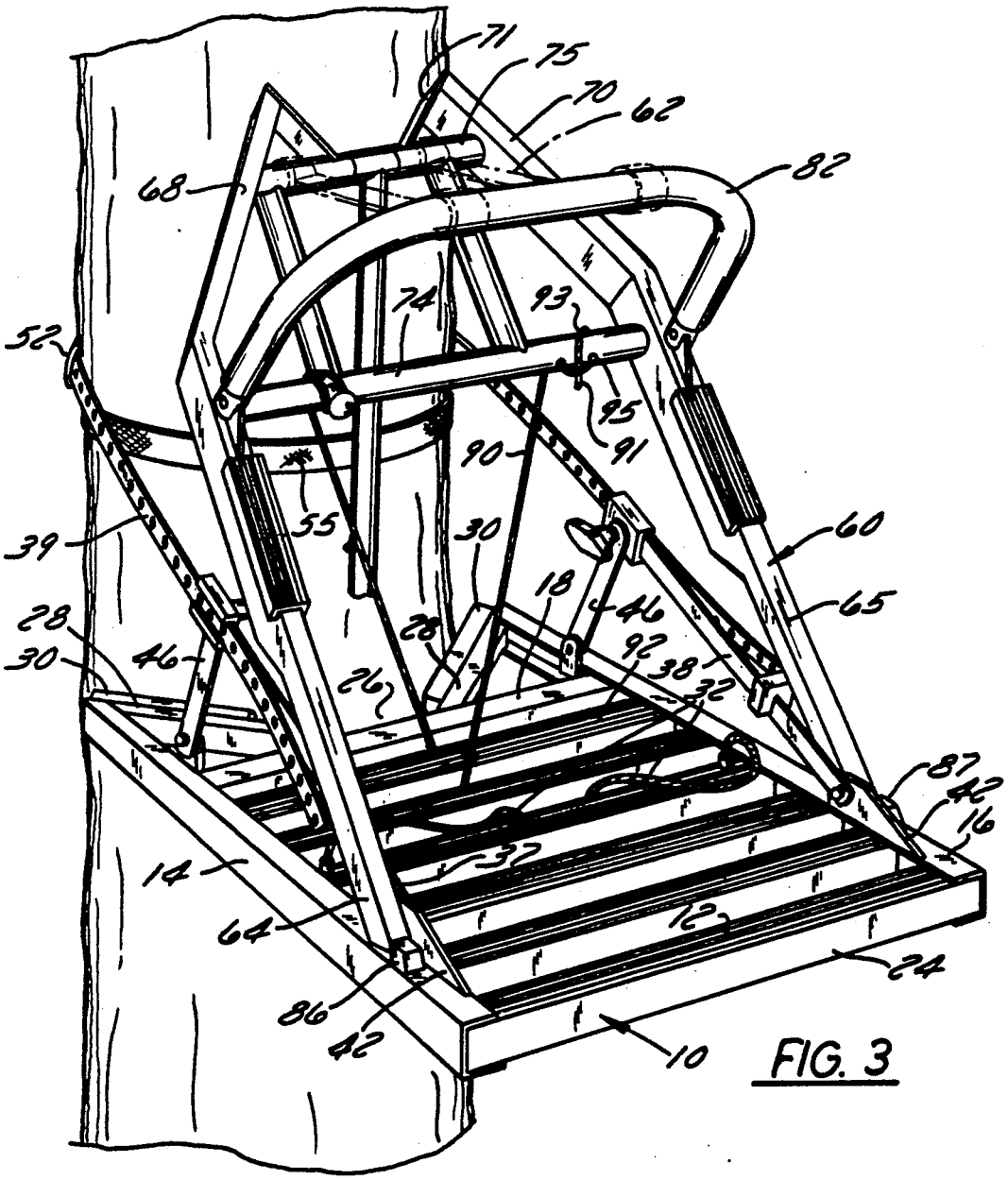
FIG. 3 is a perspective view of the combination of the components shown in FIGS. 1 and 2.

Referring next to FIG. 3, the combination of the stand 10 and the locking member 60 is shown in place against a tree. It will be appreciated that the outer ends of side members 64 and 65 are abutted against stops 86 and 87 provided on side members 14 and 16 so that the notch 71 of the locking member leans against the tree at a level generally above the level of the platform 12 and above the level of the surrounding band portion 39. The new feature shown in FIG. 3 is an elongate rope 90 for coupling the two components between rod 74 and the second rung 92 of platform 12, i.e., the second rung outwardly from notch 26. While many techniques can be employed to tie those two components together using a rope, strap or webbing, in the illustrated embodiment a first end of a rope 90 is tied to rod 74 at the side thereof generally adjacent side member 64 by having it pass through a hole 94 in rod 74 and being knotted so that it cannot pull through the hole. The rope then extends downwardly around rung 92 and upwardly through holes 94 and 95 on the opposite side of rod 74 as will be described in greater detail below. By pulling on the rope, the rod 74 and rung 92 are drawn toward one another thereby urging the notch 71 of the locking device 60 downwardly on the tree and pushing the ends of side members 64 and 65 downwardly into the side members 14 an 16 of the platform 12, thereby locking the entire system. The rope is secured in position until it is desirable to move the stand.

Using the system described in these three FIGURES, a tree stand is provided which has greater stability during movement of the user about the surface of the stand than would be provided without the locking system. In addition, in the illustrated embodiment, the convenience of a seat is also made available to the user. Obviously, at all times, it is desirable to use safety straps with the stand, even with the greater stability, and it is the intention of the inventor and the assignee of this invention that such straps always be used for obvious safety reasons.

Figure 4:
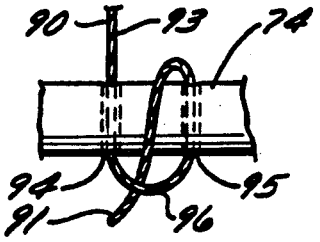
FIG. 4 is an illustration of the rope locking technique.

In FIG. 4, a locking technique for a rope passing through a rod is illustrated and forms a separate aspect of the present invention. This technique would be particularly applicable for the attachment of the second end 93 of the rope 90 through rod 74. The locking arrangement consists of providing a pair of parallel but spaced apart holes 94 and 95 through the rod 74 with rope 90 extending downwardly (by reference to the illustration) through the inner one of the holes 94 and then being fed back upwardly through the outward hole 95. The free end 95 of the rope would then be looped back across the rod and down through the loop 96 formed between the two holes. Tightening of the rope in this manner provides a non-slip knot arrangement which is convenient to use and which, to the knowledge of the present inventor, is a unique system with wide applicability.

In addition to the use of this locking arrangement for tree stand locking devices, the system could be used for a wide variety of applications such as in the construction of playground equipment, water ski equipment and, in fact, in any system where it is desired to attach an end of a rope, strap or webbing to a member which could have a pair of parallel holes provided therein. This feature, like others described previously, is therefore not to be limited by the illustrations but is to be limited solely the claims which follow.

While the present invention has been described in connection with a particular application, the invention is not to be limited thereby but is to be limited solely by the scope of the claims which follow.

What is claimed is:

1. A tree stand having increased stability comprising:

a platform having first and second opposed ends and first and second opposed sides;

a notch in the first end for abutting a tree and at least partially surrounding a peripheral section thereof;

a band means having an intermediate portion for being placed about a tree and first and second ends coupled respectively adjacent the first and second sides of the platform and generally nearer the second end of the platform;

a securing device for being coupled to said platform and including a pair of spaced apart elongate elements having first ends coupled to said platform and second ends converging into a tree engaging portion, said elements forming an acute angle with the said platform when the second ends thereof engage a tree, coupling means for interconnecting said elements and adjustable means for tying together the coupling means and the platform.

2. The tree stand of claim 1 wherein the band means intermediate portion and the notch include resilient material for preventing damage to a tree during use of the tree stand.

3. The tree stand of claim 1 wherein the length of said band means is adjustable and said first and second ends of said band are pivotally coupled to the platform.

4. The tree stand of claim 1 wherein said platform includes strap means for attaching said platform to the footwear of the user.

5. The tree stand of claim 1 wherein said platform comprises a plurality of rungs extending perpendicularly between the first and second opposed sides.

6. The tree stand of claim 1 wherein the securing device includes a seat.

7. The tree stand of claim 1 wherein said coupling means comprises a bar extending between said elements generally nearer said engaging portion.

8. The tree stand of claim 7 wherein the tying means comprises an elongate, flexible element securedly drawing said bar toward said platform.

9. The tree stand of claim 8 wherein said flexible element is selected from the group consisting of ropes, straps or webs.

10. The tree stand of claim 7 wherein said platform comprises a plurality of rungs extending perpendicularly between said first and second opposed sides and the tying means comprises an elongate, flexible element drawing said bar toward one of said rungs located generally nearer the platform notch.

11. The tree stand of claim 1 wherein the first ends of said elements are received in holes in said platform.

12. The tree stand of claim 1 wherein said first ends of said elements are pivotally coupled to said platform.

13. The tree stand of claim 1 wherein the platform includes a pair of hollow frame members defining said first and second opposed sides and said first ends of said elements are received in holes provided in said hollow frame members.

14. A lock-down tree stand comprising a platform including a pair of side elements and a plurality of spaced apart rung elements located therebetween, an adjustable band having first and second ends secured to the platform and an intermediate portion adapted to be placed about a tree, a notch in one end of said platform for being placed into an abutting relationship with a tree, the improvement comprising a locking element for being combined with said platform comprising:

i. a pair of elongate side beams having first ends releasably coupled to said side elements of said platform, said beams each having a converging portion leading to second ends which define a tree engaging portion located above the notch of the platform;

ii. at least one rod between the side beams;

iii. flexible tying means for drawing together and securingly attaching one of the rods to a rung of the platform.

15. The tree stand of claim 14 wherein said locking element includes a seat.

16. The tree stand of claim 15 wherein said tying means is selected from the group consisting of ropes, straps or webs.

17. The tree stand of claim 14 wherein said rod includes a pair of generally adjacent, parallel spaced-apart holes and said flexible tying means passes in one direction through one of said holes, in the opposite direction through the other of said holes and a leading end of said tying means is passed through the loop formed between the two holes to attach one end of the tying means to the rod.

* * * * *